US007004095B2

(12) United States Patent
Bronneberg et al.

(10) Patent No.: US 7,004,095 B2
(45) Date of Patent: Feb. 28, 2006

(54) CARGO VENTING SYSTEM

(75) Inventors: Jos Bronneberg, Nieuwerkerk aan del IJssel (NL); Dirk de Vos, Eze sur Mer (FR)

(73) Assignee: Single Buoy Moorings, Inc., Houston, TX (US)

( * ) Notice: Subject to any disclaimer, the term of this patent is extended or adjusted under 35 U.S.C. 154(b) by 0 days.

(21) Appl. No.: 11/005,509

(22) Filed: Dec. 6, 2004

(65) Prior Publication Data

US 2005/0172877 A1 Aug. 11, 2005

Related U.S. Application Data

(60) Provisional application No. 60/532,364, filed on Dec. 23, 2003.

(51) Int. Cl.
*B63B 25/08* (2006.01)

(52) U.S. Cl. ..... 114/74 R; 114/211

(58) Field of Classification Search ..... 114/74 R, 114/211

See application file for complete search history.

(56) References Cited

U.S. PATENT DOCUMENTS 5,285,745 A * 2/1994 Husain ..... 114/74 R

FOREIGN PATENT DOCUMENTS

DE 102 11 645 A1 9/2003

OTHER PUBLICATIONS

International Maritime Organization, "Revised Guidelines for Inert Gas Systems", Jul. 4, 1983, MSC/Circ. 353 (Ref. T4/4.03), pp. 1 to 47.

* cited by examiner

*Primary Examiner*—Stephen Avila

(74) *Attorney, Agent, or Firm*—Leon D. Rosen

(57) ABSTRACT

A vessel (14) that stores crude oil in tanks (12A–12H) in the vessel hull, maintains oxygen-free gas in the tank spaces (32) that lie above the crude oil. This is achieved by flowing in hydrocarbon-inert gas (gas that does not react with hydrocarbons), such as flue gas, when crude oil is removed so the crude oil level drops, and by flowing out vent gas that includes the inert gas and gaseous hydrocarbons that come from the crude oil, when crude oil flows into the tank and the oil level rises. An inert gas pipe (50) is used to flow inert flue gas into the tanks, and a separate vent gas pipe (52) is used to flow out the vent gas. A vacuum is applied to the vent pipe by connecting the vent pipe to an eductor (102) through which pressured gas, such as steam, is flowed. The vent gas is usually released into the atmosphere, but is burned when there is almost no wind, to prevent a buildup of hydrocarbon gas on the vessel deck.

6 Claims, 2 Drawing Sheets

FIG. 1
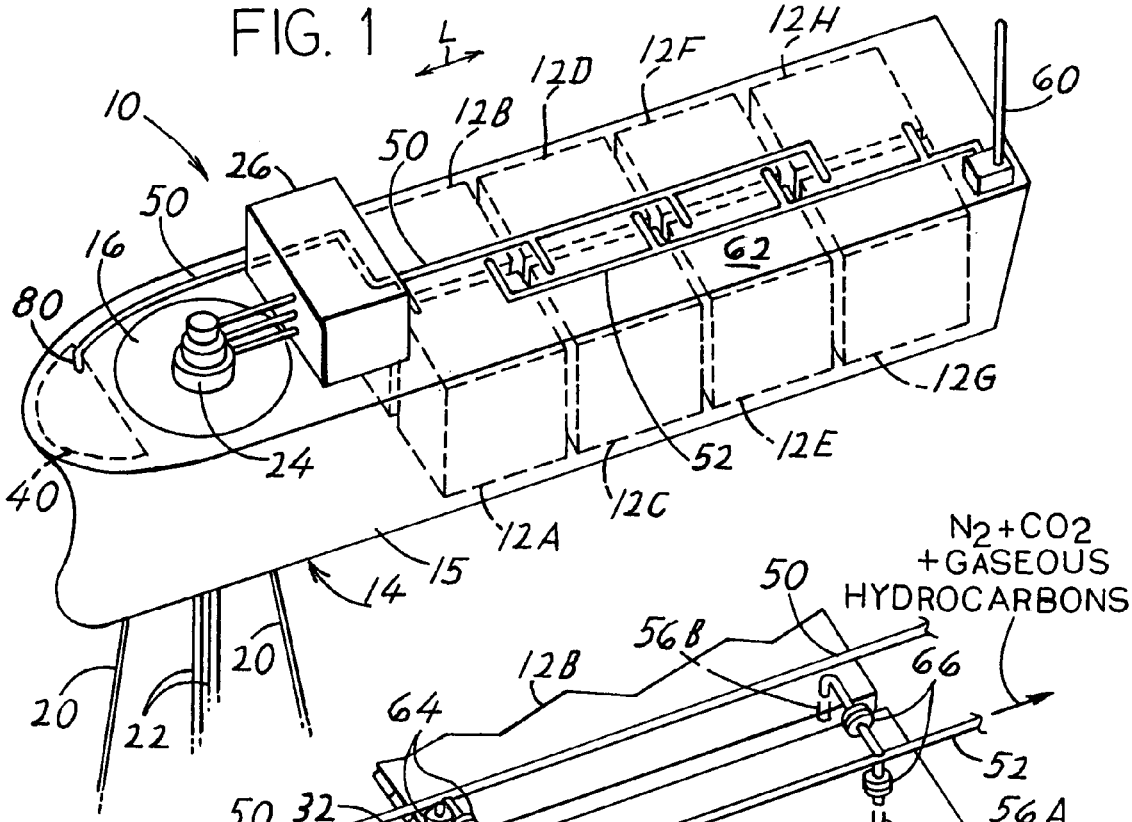
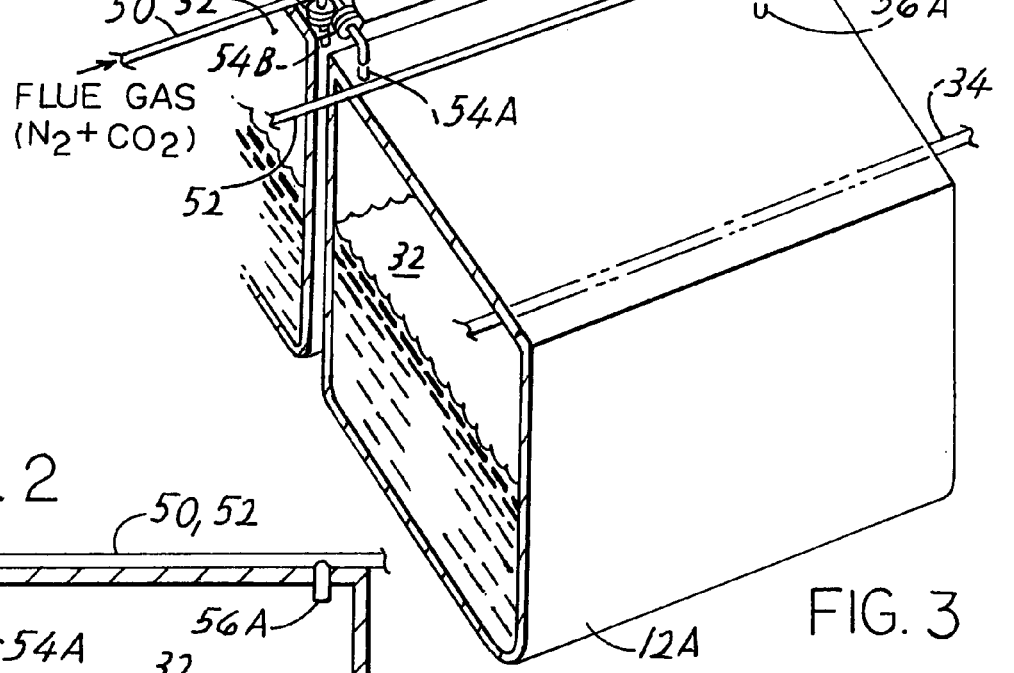
FIG. 3
FIG. 2
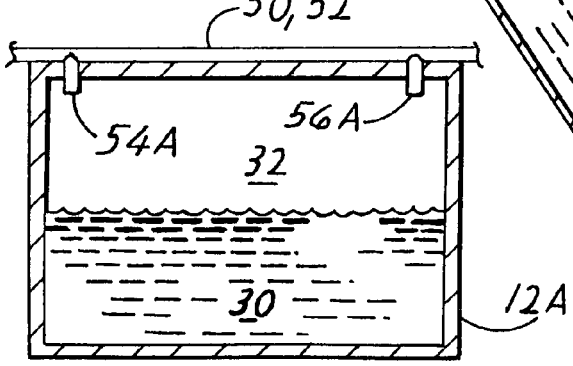

CARGO VENTING SYSTEM

CROSS-REFERENCE

Applicant claims priority from U.S. Provisional Patent Application Ser. No. 60/532,364 filed Dec. 23, 2003.

BACKGROUND OF THE INVENTION

Crude oil such as that produced from an undersea hydrocarbon reservoir, is usually stored in tanks in the vessel hull. Components of the crude oil evaporate and fill the upper spaces of the tanks. It is important to keep oxygen out of the tanks, to avoid a fire. When crude oil is removed from the tanks so the level of crude oil falls, hydrocarbon-inert gas (gas that does not react with hydrocarbons) is flowed into the tanks to prevent the entrance of air. When crude oil flows into the tanks so the level of crude oil rises, gas is removed from the tanks. The removed, or vented gas includes evaporated hydrocarbons in addition to the inert gas.

The vented gas, which is volatile because of the hydrocarbons in it, can be simply released into the atmosphere. However, if the vessel is moored so it does not continually move, then on calm days when there is little wind there is a danger that the vented gas will accumulate on the vessel deck and present a hazard. A system that was versatile in the maintenance of oxygen-free gas above crude oil in vessel tanks and in the safe disposal of vent gas containing hydrocarbon gas, would be of value.

SUMMARY OF THE INVENTION

In accordance with one embodiment of the invention, applicant provides a system for maintaining oxygen-free gas in the upper spaces of crude oil-containing tanks of a vessel, which is versatile and safe. The system includes an inert gas pipe that carries inert gas (gas that does not react with hydrocarbons) and that has outlets that open into each of the tanks. The system also includes a vent gas pipe that has inlets that open into each of the tanks. Whenever oil flows out of a tank so the oil level falls, inert gas flows into the tank to maintain a gas pressure therein that avoids the leaking in of air and the consequent leaking in of oxygen that constitutes part of air. Whenever oil flows into a tank so the oil level rises, some of the vent gas that lies in the tank exits the tank and flows though the vent pipe and may be merely released into the atmosphere or burned at a flare.

When the vent gas is to be burned at the flare, the pressure of gas supplied to the flare is increased for proper operation. This can be accomplished by providing an eductor through which a gas such as steam flows. The vent pipe has an outlet that faces downstream along a narrowed part of the eductor.

The novel features of the invention are set forth with particularity in the appended claims. The invention will be best understood from the following description when read in conjunction with the accompanying drawings.

BRIEF DESCRIPTION OF THE DRAWINGS

FIG. 1 is an isometric view of a vessel that contains a cargo venting system of the invention.

FIG. 2 is a sectional view of one of the tanks of the vessel of FIG. 1.

FIG. 3 is a partial sectional view of a pair of tanks of the vessel of FIG. 1.

DESCRIPTION OF THE PREFERRED EMBODIMENTS

Figure 4:
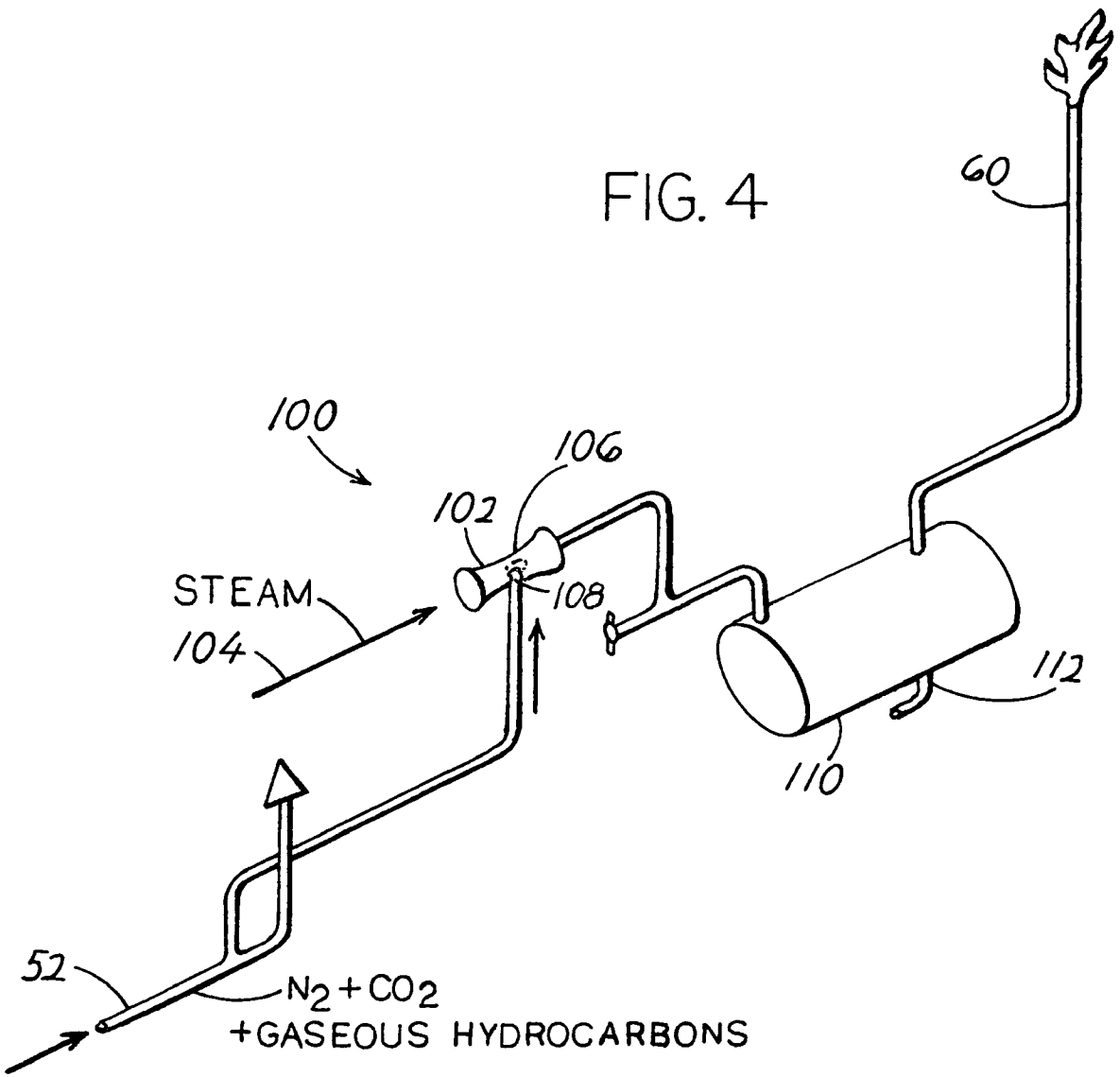
FIG. 4 is an isometric view of apparatus for boosting the pressure of vent gas to be burned in the system of FIG. 1.

FIG. 1 illustrates a system 10 which includes a floating structure such as a vessel 14 that has a hull 15 with crude oil tanks 12A–12H that store crude oil. The particular vessel 14 is a barge of a FPSO type (floating, production, storage, and offloading) that has a turret 16 that is anchored to the sea floor by chains 20, although a spread moored or other type of mooring can be used. Crude oil from an undersea reservoir passes up through risers 22 to fluid swivels 24, from which the crude oil flows to a crude processor 26. The processor separates out crude oil from sand, gaseous hydrocarbons, etc. and passes the crude oil to the tanks 12A–12H. A gas flare may be provided for the processor.

FIGS. 2 and 3 illustrate two of the tanks 12A and 12B that are each about half filled with liquid hydrocarbons 30, which may be referred to as crude oil. The space 32 above the crude oil is initially filled with an inert gas, which is herein defined as a gas that does not chemically react with hydrocarbons. The inert gas may be nitrogen obtained by liquefaction of air, but is preferably flue gas obtained from a boiler room 40 (FIG. 1) by burning hydrocarbons with air, in which case the flue gas comprises nitrogen and carbon dioxide. The inert gas is supplied to tanks during offloading to fill the space previously occupied by crude oil. During loading, the inert gas and hydrocarbon gas in the space 32 is displaced and passes (though a vent pipe 52) and may be released into the atmosphere.

Some of the hydrocarbons stored in the tanks (the more volatile components) evaporate and lie in the space 32 above the liquid hydrocarbons along with the inert gas. Air is prevented from entering a tank when crude oil lies in the tank, to prevent fire (which requires the oxygen in air to burn with hydrocarbons). Air is allowed in a tank (by passing it in through a separate air pipe 34 dedicated to that function) only during maintenance when crude oil has been removed and personnel must enter a tank. Each tank holds many thousands of gallons of crude oil, and if the space above them should hold some air and ignite, there could be a disaster.

A pair of pipes 50, 52 are provided that each extends along at least about half of the length of the vessel. Pipe 50 is an inert gas pipe that carries inert gas (inert to hydrocarbons) such as flue gas from the boiler room to the tanks. The inert pipe 50 has a plurality of outlets 54 such as 54A and 54B that each opens to the upper portion of a tank 12A–12H (and other, auxiliary tanks) to supply inert gas to the space above the liquid hydrocarbons. Vent pipe 52 has a plurality of inlets 56, such as 56A and 56B that each receives gas from the space 32 at the top of a crude oil storage tank. As a result, there is a flow of inert gas though an outlet 54 into each tank during offloading of crude oil, and there is an outflow of gas though an inlet 56 during the filling of each tank. The outflowing gas includes some of the inert gas earlier admitted into the upper tank space though an inert gas outlet 54, and also includes gaseous hydrocarbons that have evaporated into the upper tank space.

It would be possible to use only a single pipe, instead of the separate inert and vent pipes 50, 52, to flow inert gas into the tanks and flow out vent gas from the tanks. However, with a single pipe it is necessary to closely control flow at all times, so as to assure that vent gas flows only rearward to a place where it is released into the environment, to assure that flue gas flows only to the tanks and not to the place where gas is released into the environment, and to assure that gas flow is controlled in accordance with whether the tanks are being filled or emptied. Applicant's use of two separate pipes 50, 52 minimizes the need for complete flow control, and increases versatility of flow control.

Applicant prefers to provide check valves at 60 and 62 (FIG. 3) along the inert gas outlets and along the vent gas inlets, to assure proper flow of gasses. The inert pipe check valves 60 assure that gas flows only into a tank though an inert gas inlet 54, and prevents the flow of vent gas (with entrained hydrocarbons) into the inert gas pipe 50. The vent pipe check valves 62 assure that gas flows only out of a tank though a vent gas outlet, and prevents the flow of vent gas (with entrained hydrocarbons) from flowing into a tank instead of inert gas flowing into the tank. So long as inert gas is available to flow into the inert pipe 50 and vent gas can flow though and out of the vent pipe 52, during the flow of crude oil into or out of the tanks, the cargo venting system of the invention will operate properly. Applicant notes that safety valves (not shown) are also connected to the tanks to assure that the pressure in each tank is not more or less than 2.5 psi (1800 mm of water) different from atmospheric pressure.

The presence of two cargo venting pipes 50, 52 allows other operations to be easily controlled. For example, it is sometimes necessary to flow crude oil from one tank to another, as to balance the vessel. The presence of the two pipes results in inert gas automatically flowing into the tank being emptied, simultaneously with the outflow of vent gas from the tank being filled. This cannot be easily done with a single pipe.

The inert pipe outlets 54 and vent gas inlets 56 are preferably spaced apart by more than half the length of each tank. This helps mix any inert gas being delivered to a tank, with the gas already in the tank, to maximize inert gas and minimize gaseous hydrocarbons in the space at the top of a tank.

As mentioned above, applicant prefers to release vent gas into the environment though a vent gas outlet 60 (FIG. 1). Under most conditions, there is a breeze and the released vent gas dissipates. However, if the weather is very calm so there are little if any winds, then there is a possibility that the released vent gas will accumulate on the deck 62 of the vessel. The hydrocarbons in the vent gas then could catch fire. To prevent this, applicant provides a flare system (which includes headers, and a drum and flare tip) which includes a flare tip at 60. The flare tip is lit to burn the gaseous hydrocarbons of the combination of inert gas ($CO_2$ and $N_2$) and hydrocarbons that has passed along the vent pipe 52. The outlet or flare 60 lies at the stern of the weathervaning vessel, so any winds carry the gas (burned or unburned) away from the vessel.

FIG. 4 illustrates a flare system 100 that is connected to the vent pipe 52 which carries hydrocarbons and inert gas, and that includes the flare 60. The flare system includes an eductor 102 that receives inert pressured gas from a source 104. The eductor has a region 106 of reduced diameter, where the pressure is reduced, and to which the vent pipe is connected and points downstream. The eductor boosts the pressure of gas supplied to the flare when the vent gas is to be burned, because the flare working pressure is between 1 and 10 bars (about one and ten atmospheres). The eductor mixes the vent gas and the pressured inert gas from the source 104, and delivers the combination to a flare drum 110 that separates liquid from gas and drains away any liquids at 112. The gases are burned at the flare 60. The pressured gas from source 104 can be steam from a boiler at the bow end of the vessel.

Thus, the invention provides a system for venting cargo tanks that hold crude oil. The system includes an inert gas pipe that carries gas that does not react with hydrocarbons, such as flue gas ($CO_2$ and $H_2$), though outlets to the tanks. The system also includes a separate vent pipe with inlets, that carries away gas from the tanks, such as gaseous hydrocarbons mixed with flue gas. Check valves are preferably located along each inlet and along each outlet. The system operates properly with minimum control. Vent gas in the vent pipe is released into the environment at the stern of the vessel, or is burned in the event that there is little wind. The pressure of the vent gas can be increased by the use of an eductor that receives pressured gas from the bow end of the vessel, such as steam.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A method for assuring maintenance of oxygen-free gas in the empty spaces of crude oil-holding tanks in a vessel which includes passing inert gas that is inert to hydrocarbons through an inert gas pipe into upper tank portions that lie above crude oil in the tanks at least when the crude oil levels decrease, and withdrawing vent gas that lies in said upper portions of the tanks through a vent gas pipe that is separate from said inert gas pipe, at least when the tank crude oil levels increase, wherein:

when the winds in the vicinity of said vessel are strong, releasing said vent gas to the atmosphere without burning it;

when the winds in the vicinity of said vessel are calm, burning said vent gas, to thereby avoid a buildup of hydrocarbon gas on a vessel deck that lies over the tanks.

2. The method described in claim 1 wherein:

said step of burning vent gas includes passing an inert pressured gas through an eductor (102) while flowing said vent gas in a downstream direction into the eductor and flowing gas from the eductor to a flare tip (60) and burning gas at the flare tip.

3. The method described in claim 2 wherein a bow end of said vessel is moored to weathervane so its bow end faces upwind, and wherein:

said step of passing includes generating steam (40) at the bow end of the vessel, locating said eductor at the stern end of the vessel, and carrying the steam through the eductor at the stern end of the vessel while passing the vent gas downstream into the eductor.

4. A vessel that includes a hull that is moored at a mooring location, the vessel having a plurality of tanks that each is designed to hold crude oil, including a system for keeping oxygen out of tank upper spaces that lie above crude oil therein, including an inert gas pipe having a plurality of outlets each connected to one of said tank upper spaces, a vent gas pipe having a plurality of inlets each connected to one of said tank upper spaces, a source of hydrocarbon inert gas which does not react with hydrocarbons connected to said inert gas pipe to flow said inert gas therealong and into said outlet, and a gas vent for disposing of said vent gas, and that is connected to said vent gas pipe, including:

means connected to said gas vent for releasing said vent gas into the atmosphere without burning it when there are strong winds around the vessel, and for burning said vent gas when there are calm wind conditions.

5. A vessel that includes a hull that is moored at a mooring location, the vessel having a plurality of tanks that each is designed to hold crude oil, including a system for keeping oxygen out of tank upper spaces that lie above crude oil therein which includes an inert gas pipe having a plurality of outlets each connected to one of said tank upper spaces, a vent gas pipe having a plurality of inlets each connected to one of said tank upper spaces, a source of hydrocarbon inert gas which does not react with hydrocarbons connected to said inert gas pipe to flow said inert gas therealong and into said outlet, and a gas vent that leads to the atmosphere and that is connected to said vent gas pipe, including:

a plurality of inert check valves each lying along one of said outlets and allowing gas flow in said inert gas pipe only from said inert gas pipe into a corresponding tank and not out of the tank into the inert gas pipe;

a plurality of vent check valves each lying along one of said inlets and allowing has flow in said vent gas pipe only from a tank into said vent gas pipe and not from said vent gas pipe into a tank.

6. The vessel described in claim 4 wherein:

said means for releasing and burning includes a gas pump lying along said vent pipe, said gas pump including a source of pressured gas, an eductor with input and output ends, said source connected to said eductor input end to flow said pressured gas through said eductor, and said vent gas pipe having an end extending into said eductor and pointing downstream along said restriction.

* * * * *